United States Patent [19]

Matsuura et al.

[11] Patent Number: 4,776,306

[45] Date of Patent: Oct. 11, 1988

[54] VALVE OPERATING SYSTEM FOR INTERNAL COMBUSTION ENGINE

[75] Inventors: Masaaki Matsuura, Tokyo; Masaharu Nakamori; Masahiro Kuroki, both of Saitama, all of Japan

[73] Assignee: Honda Giken Kogyo Kabushiki Kaisha, Tokyo, Japan

[21] Appl. No.: 939,164

[22] PCT Filed: Apr. 4, 1986

[86] PCT No.: PCT/JP86/00161

§ 371 Date: Feb. 5, 1987

§ 102(e) Date: Feb. 5, 1987

[87] PCT Pub. No.: WO86/05842

PCT Pub. Date: Oct. 9, 1986

[30] Foreign Application Priority Data

| | | | |
|---|---|---|---|
| Apr. 5, 1985 | [JP] | Japan | 60-71105 |
| Apr. 5, 1985 | [JP] | Japan | 60-71106 |
| Apr. 5, 1985 | [JP] | Japan | 60-71107 |
| Apr. 10, 1985 | [JP] | Japan | 60-52110[U] |

[51] Int. Cl.[4] ..... F01L 7/00

[52] U.S. Cl. ..... 123/80 R; 123/190 A

[58] Field of Search ..... 123/80 R, 80 BA, 80 BV, 123/80 DA, 190 R, 190 B, 190 D, 90.6, 90.31, 190 A

[56] References Cited

U.S. PATENT DOCUMENTS

| | | | |
|---|---|---|---|
| 1,104,075 | 7/1914 | Shaw | 123/80 BA |
| 2,411,321 | 11/1946 | Hall | 123/80 DA |
| 3,526,612 | 9/1970 | Henvaux . | |
| 3,730,161 | 5/1973 | Deane . | |

FOREIGN PATENT DOCUMENTS

| | | | |
|---|---|---|---|
| 303400 | 11/1954 | Italy | 123/80 DA |
| 55-1953 | 1/1980 | Japan . | |
| 56-92706 | 7/1981 | Japan . | |
| 58-148372 | 10/1983 | Japan . | |
| 60-26111 | 2/1985 | Japan . | |

*Primary Examiner*—Henry A. Bennett

*Attorney, Agent, or Firm*—Lyon & Lyon

[57] ABSTRACT

In an internal combustion engine in which intake and exhaust rotary valves each having a spherical valve body are controlled in opening and closing through a valve operating mechanism interlockingly with the movement of a piston, the intake and exhaust rotary valves (10, 20; 110, 120; 210, 220; 310, 310', 320, 320') respectively assume the fully opened positions to open intake and exhaust passages (7, 8; 107, 108; 207, 208; 307, 307', 308, 308'), during the intake and exhaust strokes of the engine (1; 101; 201; 301), and assume the fully closed positions during the explosion stroke. In the fully opened and closed positions, the intake and exhaust rotary valves (10, 20; 110, 120; 210, 220; 310, 310', 320, 320') are held at a stop state for a predetermined period of time by the intermittently operating function of the valve operating mechanism (30; 130; 230; 330).

9 Claims, 14 Drawing Sheets

VALVE OPERATING SYSTEM FOR INTERNAL COMBUSTION ENGINE

TECHNICAL FIELD

The present invention relates to a valve operating system for an internal combustion engine and more particularly, to a valve operating system for an internal combustion engine, which uses a spherical rotary valve.

TECHNICAL SUBJECT

A poppet valve used in a valve operating system of a usual internal combustion engine is currently employed in most of internal combustion engines because of its good sealing property. When an improvement in performance of the internal combustion engine is intended to be provided, however, the use of the poppet valve is accompanied by the various disadvantages: A hot exhaust valve exposes its appearance into a combustion chamber to promote the generation of a detonation and a preignition; the presence of a valve stem and a valve head in a passage results in a resistance to the passing of a gas to cause a degradation in intake and exhaust efficiencies; because the poppet valve has the valve stem and the valve head, intake and exhaust passages are curved in the vicinity of the valve, resulting in a degradation in intake and exhaust efficiencies; because the valve is reciprocally moved by the valve stem, a space elongated in the direction of such reciprocal movement is required, resulting in a large-sized engine; and because the opening and closing of the valve are conducted by the reciprocal movement of the valve stem, a shock noise is generated during closing of the valve.

To overcome the disadvantages found in the use of the poppet valve, a large number of sleeve valves and rotary valves have been proposed and particularly, studies have been made for rotary valves such as spherical, cylindrical, conical and disk-shaped valves.

However, all of rotary valve systems which have been hithereto proposed are of an arrangement such that to avoid a reciprocal movement, a rotational movement is continuously imparted, whereby even during explosion, a valve body is rotated while being subjected to an explosion force. For this reason, it is impossible to overcome an increasement in friction and the incompleteness of sealing. In addition, because the valve body continues to rotate even during intaking and exhausting operations due to the structure of the rotary valve system, an effective opening time cannot be precisely provided, and to provide such an effective opening time precisely, it is necessary to ensure a more precise timing in opening of a valve bore and to increase the opened area of the valve bore. With the variation in configuration of the valve opening being given in this way, an opening loss may be produced in intake and exhaust ports to degrade the intake and exhaust efficiencies. The above problems retard the putting of such rotary valve systems to practical use.

DISCLOSURE OF THE INVENTION

The present invention has been accomplished with the foregoing in view and aims at providing an increasement in opened area per unit time during opening of a valve, an improvement in sealing property during explosion and a reduction in friction, as well as a compact construction of engine and an improvement in performance of assembling a valve operating mechanism or the like by holding a valve body of, particularly, a spherical rotary valve in a stational (stopped) state during opening of the valve and during a specific stroke of an engine such as an explosion stroke.

To accomplish the above object, according to the present invention, there is provided a valve operating system for an internal combustion engine, which comprises intake and exhaust rotary valves respectively disposed in intake and exhaust passages communicating with a combustion chamber in an internal combustion engine, the valves including spherical valve bodies adapted to open and close said intake and exhaust passages, respectively, and a valve operating mechanism having an intermittent operating function of rotatively driving the valve bodies of the intake and exhaust rotary valves interlockingly with the movement of a piston in the internal combustion engine to provide the opening and closing control for the intake and exhaust rotary valves, and holding the rotary valves in their opened and closed positions for a predetermined period of time.

With such arrangement, the rotary valves are stopped in their opened and closed positions for a predetermined period of time and therefore, the communication and discommunication of the intake and exhaust passages with and from the combustion chamber can be reliably achieved while insuring a silent operation by the rotation of the spherical valve bodies. Thus, the disadvantages found in the prior art are overcome.

Here, if the rotary valves are designed to be stopped for a predetermined period of time in positions to fully open the intake and exhaust passages during intake and exhaust strokes of the internal combustion engine, the intake and exhaust passages cannot be clogged up with any obstacle, so that the supply of a mixed gas through the intake passage into the combustion chamber and the discharge of an exhaust gas out of the combustion chamber into the exhaust passage may be efficiently carried out. The opened area of the rotary valve per unit time during opening of the rotary valve is increased as compared with the conventional valve system, leading to an increasement in intake and exhaust efficiencies and an improvement in output power of the internal combustion engine.

In addition, if the intake and exhaust rotary valves are designed to be stopped in their closed state for a predetermined period of time, for example, during explosion stroke of the internal combustion engine, i.e, if they are stopped for a predetermined period of time in positions in which the slide surfaces of the individual valve bodies block the corresponding opened ends of the intake and exhaust passages, then a larger load at explosion can be received on the entire slide surfaces, resulting in an improvement in sealing property during explosion stroke. Moreover, since each of the valve bodies is spherical, a reduction in friction produced due to the explosion can be provided as compared with the prior art.

In addition to the above arrangement, if the valve bodies of the rotary valves are rotatively driven in one direction by the valve operating mechanism, the entire slide surfaces of the individual valve bodies are successively exposed into the combustion chamber in such a manner to block the opened ends of the intake and exhaust passages. Therefore, the distribution in temperature of the valve body is uniform throughout the valve body, so that the deformation of the valve body due to the heat may be uniform, thus providing a further improvement in sealing property and suppressing a seizure phenomenon due to a locally increased temperature for the valve bodies.

Moreover, if the axes of the intake and exhaust passages are inclined, with respect to the axis of a cylinder containing a piston slidably fitted therein, away from each other as they go away from the combustion chamber, it is possible to provide a wider space between the intake and exhaust rotary valves, thereby increasing the freedom in layouts of the individual rotary valves and the valve operating mechanism and restraining the height of the engine, thus enabling a compact design for the engine to be achieved. An improvement is also provided in performance of assembling the rotary valves and the valve operating mechanism.

Further, from the fact that a wider space can be provided between the intake and exhaust rotary valves, the whole of the rotary valve can be large-sized and the effective port diameter can be correspondingly increased, leading to a further improvement in exhaust efficiency.

BRIEF DESCRIPTION OF THE DRAWINGS

FIGS. 1 to 9 illustrate a first embodiment of the present invention,

FIG. 1 being a schematic perspective view of an internal combustion engine to which a valve operating mechanism of the first embodiment is applied;

FIG. 2 being a sectional view illustrating a rotary valve shown in FIG. 1, which is in a closed state;

FIG. 3 being a sectional view illustrating the rotary valve shown in FIG. 2, which is in an opened state;

FIG. 5 being a plan view illustrating one embodiment of a cam in the valve operating mechanism shown in FIG. 1;

FIGS. 6 and 7 being diagrams illustrating the relationship between the cam in FIG. 5 and an arm; and FIGS. 8 and 9 being characteristic graphs illustrating the relationship of the crank angle to the opened area of the rotary valve;

FIG. 11 being an end view of the details of the valve operating mechanism shown in FIG. 10; and FIGS. 12 to 15 being sectional views illustrating the operative states of intake and exhaust rotary valves shown in FIG. 10;

FIG. 17 being a sectional view illustrating a rotary valve shown in FIG. 16, which is in a closed state; and FIG. 18 being a sectional view illustrating the rotary valve shown in FIG. 17, which is in an opened state; FIGS. 23 and 24 being views of the rotary valve shown in FIG. 22 for explaining the operation of such rotary valve.

BEST MODE FOR CARRYING OUT THE INVENTION

Several embodiments of the invention will now be described with reference to the accompanying drawings.

Figure 1:
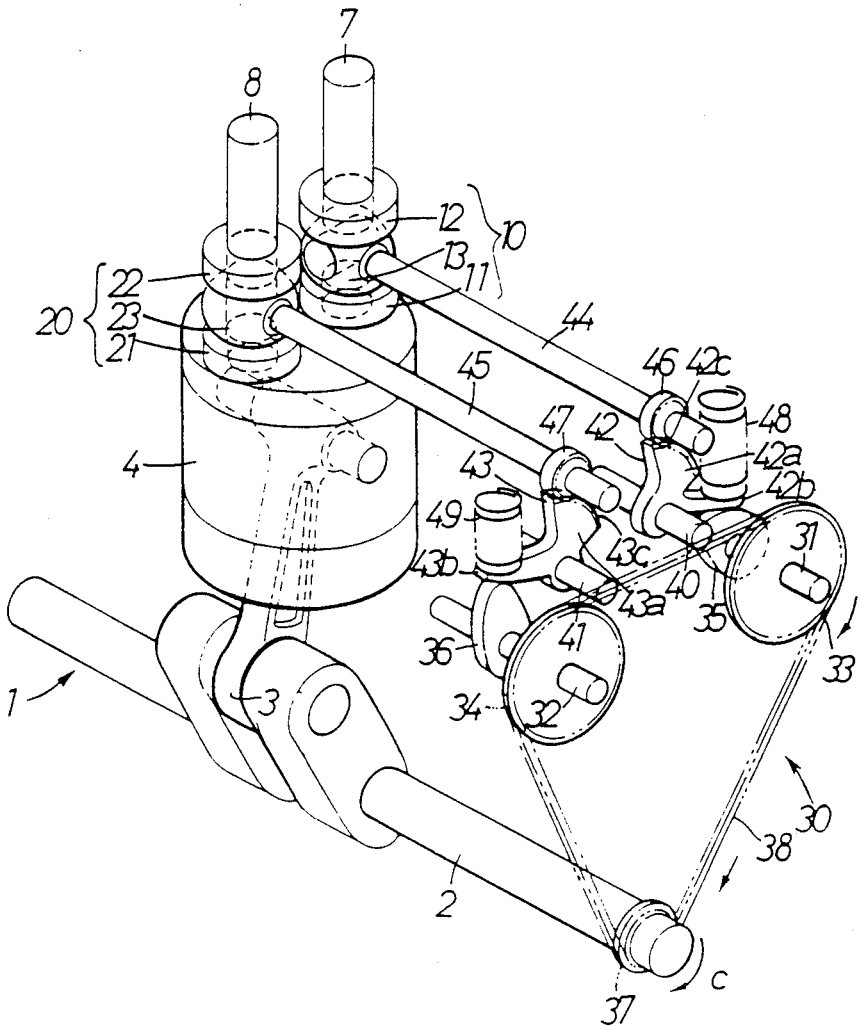
Figure 2:
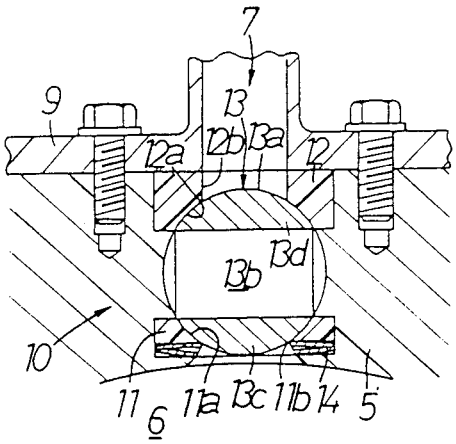
Figure 3:
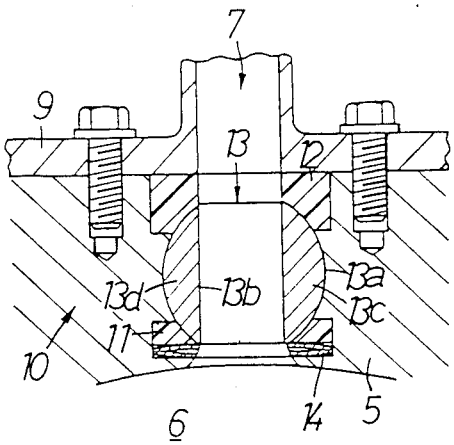

At first, a first embodiment will be described with reference to FIGS. 1 to 9. FIG. 1 illustrates the general structure of an internal combustion engine to which a valve operating system according to the present invention is applied. A piston 4 slidably fitted in a cylinder which is not shown is connected through a connecting rod 3 to a crank shaft 2 of the engine 1, and a combustion chamber 6 (FIGS. 2 and 3) is defined between the upper end surface of the piston 4 and a cylinder head 5 (FIGS. 2 and 3). A head cover 9 is overlaid and fastened on the upper surface of the cylinder head 5 by bolts. The head cover 9 is formed with an intake passage 7 and an exhaust passage 8, the passages communicating with the upper portion of the combustion chamber 6 through intake and exhaust rotary valves 10 and 20 which will be described hereinbelow, respectively. The intake rotary valve 10 and the exhaust rotary valve 20 are disposed in the cylinder head 5 adjacent to the openings, of the intake and exhaust passages 7 and 8, close to the combustion chamber 6 and are connected to a valve operating mechanism 30 which is driven by the crank shaft 2 and will be described hereinbelow.

The rotary valves 10 and 20 are spherical valves, and the rotary valve 10 is constituted of valve seat members 11 and 12, a valve body 13 and a seal spring 14, as shown in FIGS. 1 and 2. The valve seat members 11 and 12 are disk-shaped respectively, and have concave spherical valve seat surfaces **11*a* and 12*a* provided at the respective opposed one ends thereof with a predetermined radius of curvature and holes 11*b* and 12*b* bored at the central portions thereof, each of the hole having a diameter identical to the inner diameter of the intake passage 7. Each of the valve seat members 11 and 12 is formed of a material having excellent heat and wear resistances, such as a ceramic material. The valve body is in the form of a ball having a radius set equal to the radius of curvature of the valve seat surfaces 11*a* and 12*a* and includes an outer peripheral surface 13*a* which serves as a slide surface and is formed to come into close contact with the individual valve seat surfaces 11*a* and 12*a*. A bore 13*b* having a diameter equal to the inner diameter of the intake passage 7 is diametrically made in the valve body 13 at its axial center. The valve body 13** is also formed of a metal material having excellent heat and wear resistances such as a stainless steel material.

Figure 4A:
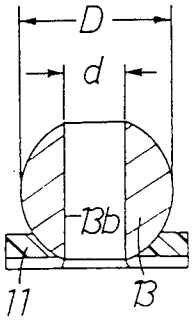
FIGS. 4A and 4B being sectional views of a valve seat member and a valve body of the rotary valve.
Figure 4B:
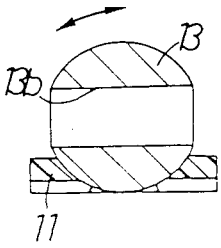

The relationship between the outer diameter D of the valve body 13 and the inner diameter d of the bore (port) **13*b* are set at an optimum value in view of a sealing property, friction and output performance, as shown in FIGS. 4A and 4B. It is to be noted that the relationship between the diameter D of the valve body 13 and the inner diameter d of the bore 13*b*** is satisfactory if $D:d=1.5$ to $2.5:1$.

In the rotary valve 10, there are the seal spring 14, the valve seat member 11, the valve body 13 and the valve seat member 12 successively arranged from the side of the combustion chamber 6, and the head cover 9 fastened to the cylinder head 5 by the bolts is fixed in abutment against the upper surface of the valve seat member 12. In this mounted state, the outer peripheral surface 13*a* of the valve body 13 is rotatably biased into slide contact with the individual valve seat surfaces 11*a* and 12*a* of the valve seat members 11 and 12 by the spring force of the seal spring 14. When the bore 13*b* in the valve body 13 is perpendicular to the intake passage 7, this passage 7 is completely shut off from the combustion chamber 6, and when the bore 13*b* is aligned with the intake passage 7, this passage 7 is completely opened into the combustion chamber 6.

The rotary valve 20 is constructed in the completely same manner as in the rotary valve 10 and disposed in the cylinder head 5 at that opened end of the exhaust passage 8 which is close to the combustion chamber 6. The operation of the exhaust rotary valve 20 to open and close the exhaust passage 8 is also similar to that of the intake rotary valve 10.

The valve operating mechanism 30 includes an intake cam shaft 31 and an exhaust cam shaft 32 which are rotatably carried by the cylinder head 5. The cam shafts 31 and 32 have driven sprockets 33 and 34 secured to the one ends thereof and cams 35 and 36 secured to, or otherwise mounted on the other ends of the shafts 31 and 32, respectively, by an integral forming. A transmitting belt, e.g., a chain 38 is passed around the drive sprockets 33 and 34 and a driving sprocket 37 secured to the crank shaft 2. First rotary shafts 40 and 41 are carried by the cylinder head 5 and have substantially L-shaped arms 42 and 43 secured to one ends thereof, respectively. Further, second rotary shafts 44 and 45 serving as driving shafts are rotatably carried by the cylinder head 5 and have gears 46 and 47 secured to one ends thereof, respectively. The respective valve bodies 13 and 23 of the rotary valves 10 and 20 are secured respectively to the other ends of the second rotary shafts 44 and 45 for rotation together with each other.

Respective one ends 42*a* and 43*a* of the arms 42 and 42 are fanned out, and teeth are cut in the arcuate outer peripheral surfaces of these one ends to constitute modified gears 42*c* and 43*c* which are meshed with the corresponding gears 46 and 47 secured to the second rotary shafts 44 and 45. The respective other ends of 42*b* and 43*b* of the arms 42 and 43 are supported on the cylinder head 5 or another fixing structure through return springs 48 and 49 and urged against the corresponding cam surfaces of the cams 35 and 36 by the resilient force from the return springs 48 and 49, respectively. The second rotary shafts 44 and 45 are secured to the valve bodies 13 and 23 to extend in a direction perpendicular to the individual bores 13*b* and 23*b*, respectively. Thus, if the second rotary shafts, i.e., driving shafts 44 and 45 are rotated about their axes, each of the bores 13*b* and 23*b* is caused to be rotated in a plane in which each of them lies.

Figure 5:
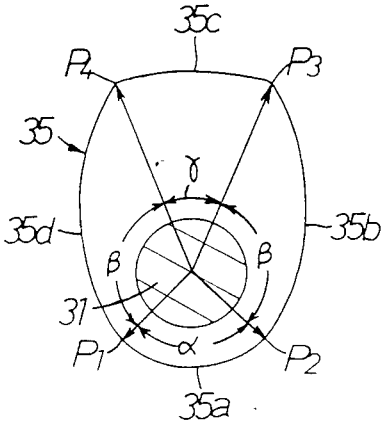

The cam surface of the cam 35 is generally formed into an egg-shaped configuration as shown in FIG. 5. A first cam surface 35*a* in a section of from P1 to P2 corresponding to a predetermined angle $\alpha$ of rotation of the intake cam shaft 31 forms a circular arc having a radius r, and a second cam surface 35*b*, in a section of from P2 to P3, connected to the first cam surface section 35*a* and corresponding to a predetermined angle $\beta$ of rotation of the cam shaft 31 forms a circular arc having a varying radius of curvature continuously increasing from the radius r to a radius R (>r) which will be described hereinbelow. In addition, a third cam surface 35*c*, in a section of from P3 to P4 corresponding to a predetermined angle $\gamma$ of rotation of the cam shaft 31, connected to the second cam surface section 35*b* and lying opposite the first cam surface section 35*a* forms a circular arc having a given radius R (>r) larger than the radius r of the first cam surface 35*a*, and a fourth cam surface 35*d* in a section of from P4 to P1 corresponding to the angle $\beta$ of the rotation of the cam shaft 31, connected to the third cam surface section 35*c* and lying opposite the second cam surface 35*b* forms a circular arc having a varying radius of curvature continuously decreasing from the radius R to the radius r in contrast with the second cam surface section 35*b*. In shorts, the cam 35 is formed laterally symmetrically with respect to a line straightly penetrating the first and third cam surfaces. The cam surface of the exhaust cam 36 is formed in the same manner as in the cam surface of the cam 35. The two cams 35 and 36 are secured to the corresponding cam shafts 31 and 32 at a predetermined phase angle in respect to each other.

The following is the description of the operation of this first embodiment.

Figure 6:
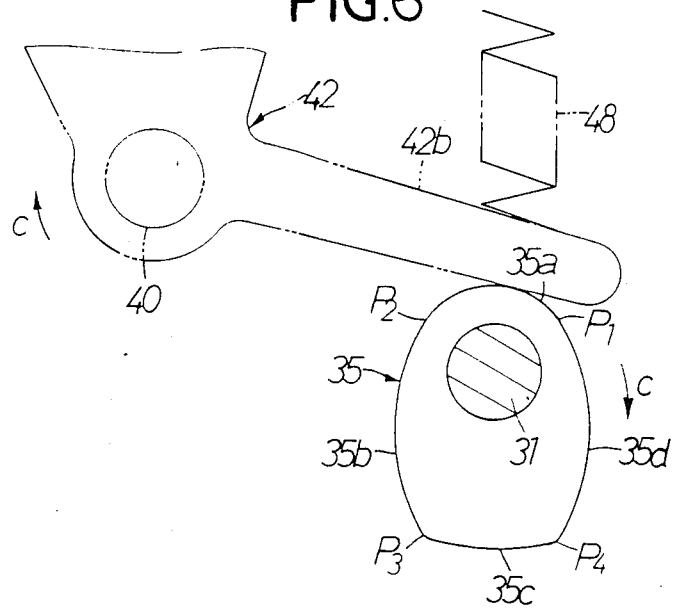

As shown in FIG. 1, when the crank shaft 2 is rotated in a clockwise direction indicated by an arrow c, the intake and exhaust cam shafts 31 and 32 are also rotated, with the rotation of the crank shaft 2, in the clockwise direction through the driving sprocket 37, the chain 38 and the driven sprockets 33 and 34. In this case, the gear ratio of the driven sprockets 33 and 34 on the cam shaft 31 and 32 to the sprocket 37 on the crank shaft 2 is set at a value of 2:1 and hence, if the crank shaft 2 is rotated in two rotations, the individual cam shafts 31 and 32 are rotated in one rotation, respectively. While the other end 42*b* of the arm 42 is in abutment against the first cam surface section 35*a* of the cam 35, the arm 42 is turned in the clockwise direction to the limit position and held in this position as shown in FIG. 6 by the spring force of the return spring 48. In accordance with this turing movement, the valve body 13 of the rotary valve 10 has the bore 13*b* held in the horizontal position as shown in FIG. 2 to bring the intake passage 7 completely shut off from the combustion chamber 6. In other words, the rotary valve 10 keeps the intake passage 7 fully closed, regardless of the rotation of the cam shaft 31, in the section of from P1 to P2 in which the other end 42*b* of the arm 42 abuts against the first cam surface.

Figure 7:
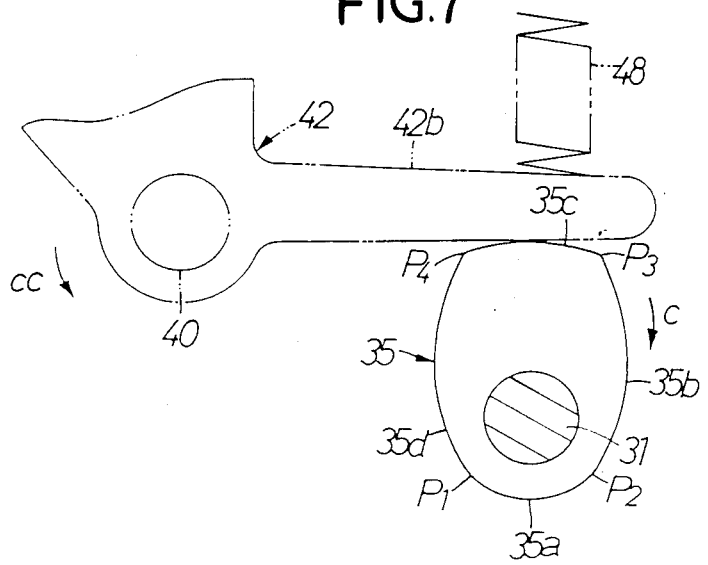

When the cam shaft 31 is further rotated, so that the abutment surface of the cam 35 against the other end 42*b* of the arm 42 shifts past the end point P2 of the first cam surface section 35*a* into the second cam surface section 35*b*, the arm 42 is turned in the counterclockwise direction (in the direction of an arrow cc in FIG. 7) against the spring force of the return spring 48 and hence, with this turning movement, the second rotary shaft 44 is rotated in the clockwise direction through the gear 46 meshed with the teeth 42*c* at one end 42*a* of the arm 42. The valve body 13 is turned in the clockwise direction along with the second rotary shaft 44 so that the bore 13*b* shifts from the horizontal position to the upright position, and in this way, the intake passage 7 is gradually opened into the combustion chamber 6 through the bore 13*b*. When the other end 42*b* of the arm 42 has reached the end point P3 of the second cam surface 35*b*, the bore 13*b* in the valve body 13 is completely aligned with the intake passage 7 as shown in FIG. 3, resulting in a largest open area thereof. As the cam shaft 31 is subsequently rotated, the other end 42*b* of the arm 42 shifts from the abuting state against the point P3 to the abuting state against the third cam surface 35*c*, and while the other end 42*b* is in abutment against this third cam surface 35c as shown in FIG. 7, the rotation of the second rotary shaft 44 is stopped and the rotation of the valve body 13 is also stopped. Until the other end 42b of the arm 42 reaches the end point P4 of the third cam surface section 35c, the bore 13b in the valve body 13 is held in the upright position shown in FIG. 3. In other words, in the section from P3 to P4 in which the other end 42b of the arm 42 abuts against the third cam surface 35c, the rotary valve 10 is stopped in such a state to fully open the intake passage 7. As a result, a mixed gas fed from the intake passage 7 is efficiently passed into the combustion chamber 6 and thus, the suction efficiency is substantially improved.

When the other end 42b of the arm 42 abuts against the fourth cam surface 35d past the end point P4 of the third cam surface 35c, the arm 42, with the turning movement of the cam 35, is turned in the clockwise direction against the spring force of the return spring 48, so that the second rotary shaft 44 is rotated in the counterclockwise direction. The valve body 13 is turned in the counterclockwise direction along with the this second rotary shaft 44 and thus, the returning of the bore 13b to the horizontal position causes the valve to be gradually closed and with this closing, the intake passage 7 is gradually shut off from the combustion chamber 6. When the other end 42b of the arm 42 has reached the end point P1 of the fourth cam surface 35d, the valve body is completely closed as shown in FIG. 2 and thus, the intake passage 7 is completely shut off. In this way, during one rotation of the cam shaft 31, the arm 42 is swung and with this swinging movement, the valve body 13 is intermittently turned in the clockwise and counterclockwise directions so that the bore 13b therein is reciprocally moved between the horizontal position and the upright position, whereby the opening and closing of the rotary valve 10 is controlled, and during opening and closing of the valve, the valve body 13 is stopped in movement and held in the opened or closed position for a predetermined period of time in accordance with the rotational speed of the crank shaft 2.

The exhaust rotary valve 20 is also operated in the same manner as in the intake rotary valve 10, and these rotary valves 10 and 20 are operated with their phases displaced from each other by a predetermined angle of rotation of the crank shaft 2. These phases are set such that during intake or suction stroke of the engine, the intake rotary valve 10 may be stopped in the fully opened position for a given period and the exhaust rotary valve 20 may be in the closed state, and during explosion stroke, both of the rotary valves 10 and 20 may be stopped in the fully closed positions, and during exhaust stroke, the rotary valve 10 may be in the closed state and the rotary valve 20 may be stopped in the fully opened position for a given period.

Therefore, according to the present invention, the opened area per unit time during opening of the rotary valves 10 and 20 can be increased as compared with that in the prior art, leading to an improvement in intake and exhaust efficiency and in output power of engine.

Figure 8:
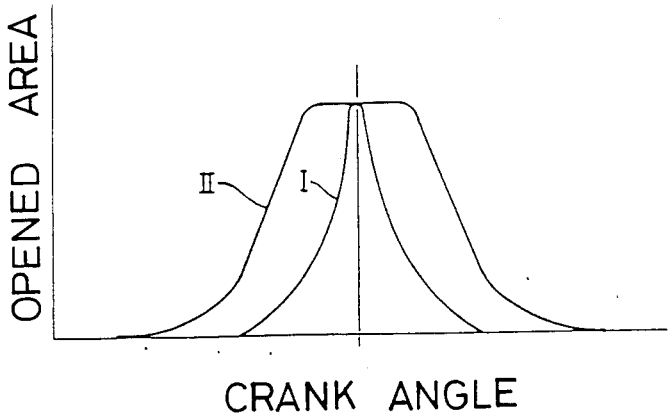
Figure 9:
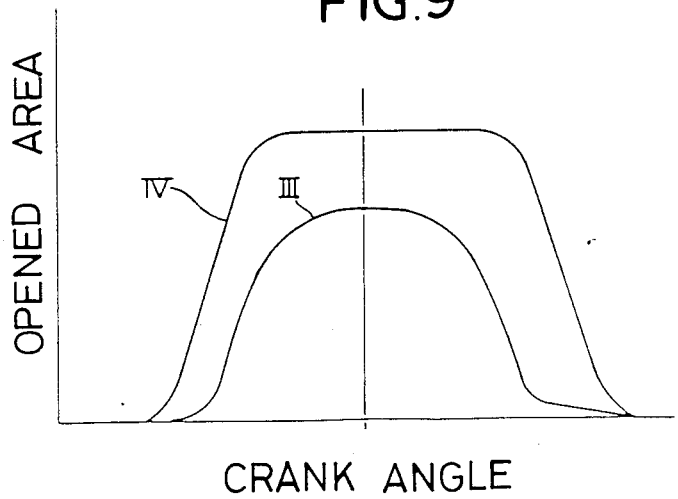

FIG. 8 is a characteristic graph illustrating the relationship between the crank angle and the opened area of the rotary valve, wherein a curve I indicates the characteristic of the prior art rotary valve having a continuously rotatable valve body, and a curve II indicates the characteristic of the rotary valve according to the present invention and having the intermittently rotatable valve body. As apparent from these characteristic curves I and II, with the valve operating system of the present invention, the intake and exhaust efficiencies are improved about two times as compared with the prior art valve. FIG. 9 is a characteristic graph illustrating the relationship between the crank angle and the opened areas of the poppet valve and the rotary valve when the diameters of the passages are equal to each other, wherein a curve III indicates the characteristic of the poppet valve and a curve IV indicates the characteristic of the rotary valve. As apparent from these characteristic curves III and IV, the valve operating system of the present invention permits the intake and exhaust efficiencies to be improved about two time as compared with the poppet valve.

Further, since the spherical bodies are used as the respective valve bodies 13 and 23 of the rotary valves 10 and 20 as described above, and the continuous rotation from the crank shaft 2 is transmitted in the form of an intermittent reciprocal movement to the valve bodies 13 and 23 through the valve operating mechanism according to the present invention, a larger road during the explosion stroke of the engine can be received by the outer peripheral surfaces 13a and 23a of the stopped spherical valve bodies 13 and 23 and consequently, it is possible to provide an improvement in sealing property and a reduction in friction during the explosion stroke. In addition, it is also possible to minimize the rotational inertia mass due to the spherical valves.

Although the system for driving the rotary valves has been described as being of the chain type for directly driving the rotary valves from the rotation of the crank shaft in the above embodiment, but it should be understood that the system is not limited to this type, and an electric driving system may be employed such as a step motor which electrically picks up the rotation of the crank shaft.

The following is the description of a second embodiment of the present invention with reference to FIGS. 10 to 15.

In the second embodiment, a Geneva stop mechanism as a valve operating mechanism 130 is substituted for the above-mentioned cam mechanism. The arrangements except the Geneva stop mechanism 130 are similar to those in the above first embodiment and therefore, the description thereof is omitted.

Figure 11:
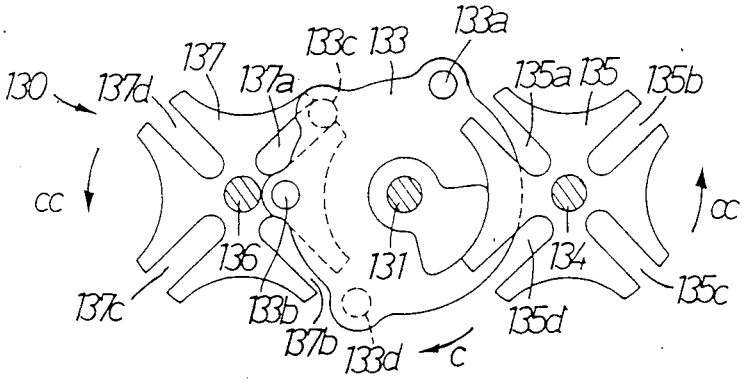

In this embodiment, the Geneva stop mechanism 130 includes a main shaft 131 which is rotatably carried on a stational arrangement such as a cylinder head 105 and has a driven sprocket 132 secured to one end thereof. The main shaft 131 is rotatively driven by a crank shaft 102 through a transmitting belt, for example, a chain 138, passed around a driving sprocket 137 secured to one end of a crank shaft 102 and around the driven sprocket 132. A driving wheel 133 is secured to the other end of the main shaft 131. Rotary shafts 134 and 136 are rotatably journaled on the stational arrangement such as the cylinder head 105 and have driven wheels 135 and 137 secured to one ends thereof, respectively. As shown in FIG. 11, two pins 133a and 133b are embedded in the peripheral edge of one end surface of the driven wheel 133 at a predetermined spaced distance on the same circumference, and two pins 133c and 133d (shown by broken lines) are also embedded in the peripheral edge of the other end surface at a predetermined spaced distance on the same circumference. On the other hand, four grooves 135a to 135d and 137a to 137d are radially provided respectively in the driven wheels 135 and 137 at circumferentially equal spaced distances at an angle of 90°. The main shaft 131 and the rotary shafts 134 and 136 to which the driving wheel 133 and the driven wheels 135 and 137 are secured are disposed in parallel at predetermined spaced distances from one another and also, the driven wheels 135 and 137 are disposed at a distance axially spaced apart from each other, the former on the side of one end surface of the driving wheel and the latter on the side of the other end surface. This enables the individual pins 133*a* and 133*b* of the driving wheel 133 to engage the grooves 135*a* to 135*d* of the driven wheel 135 and the pins 133*c* and 133*d* to engage the grooves 137*a* to 137*d* of the driven wheel 137.

When the driving wheel 133 is rotated in the clockwise direction indicated by the arrow c in FIG. 11, the driven wheel 135 is rotated in the counterclockwise direction indicated by the arrow cc from the instance when the pin 133*a* engages one of the grooves 135*a* of the driven wheel 135 to the instance when such engagement is released so that the pin is slipped out of the groove 135*a*, and subsequently, the driven wheel 135 is stopped from that instant until the pin 133*b* engages the next groove 135*b*. Consequently, for every two rotation of the driving wheel, the driven wheel 135 is rotated in one rotation with four intermittent pauses (stoppages). In the same manner as the driven wheel 135, the driven wheel 137 is rotated in one rotation with four intermittent pauses (stoppages) for every two rotations of the driving wheel 133 by the engagement of the pins 133*c* and 133*d* in the grooves 137*a* to 137*d*.

It is to be noted that the valve body 113 of the intake rotary valve 110 and the valve body 123 of the exhaust rotary valve 120 are secured respectively to the other ends of the rotary shafts 134 and 136 for rotation together with each other.

Description will now be made of the operation of the second embodiment.

Figure 10:
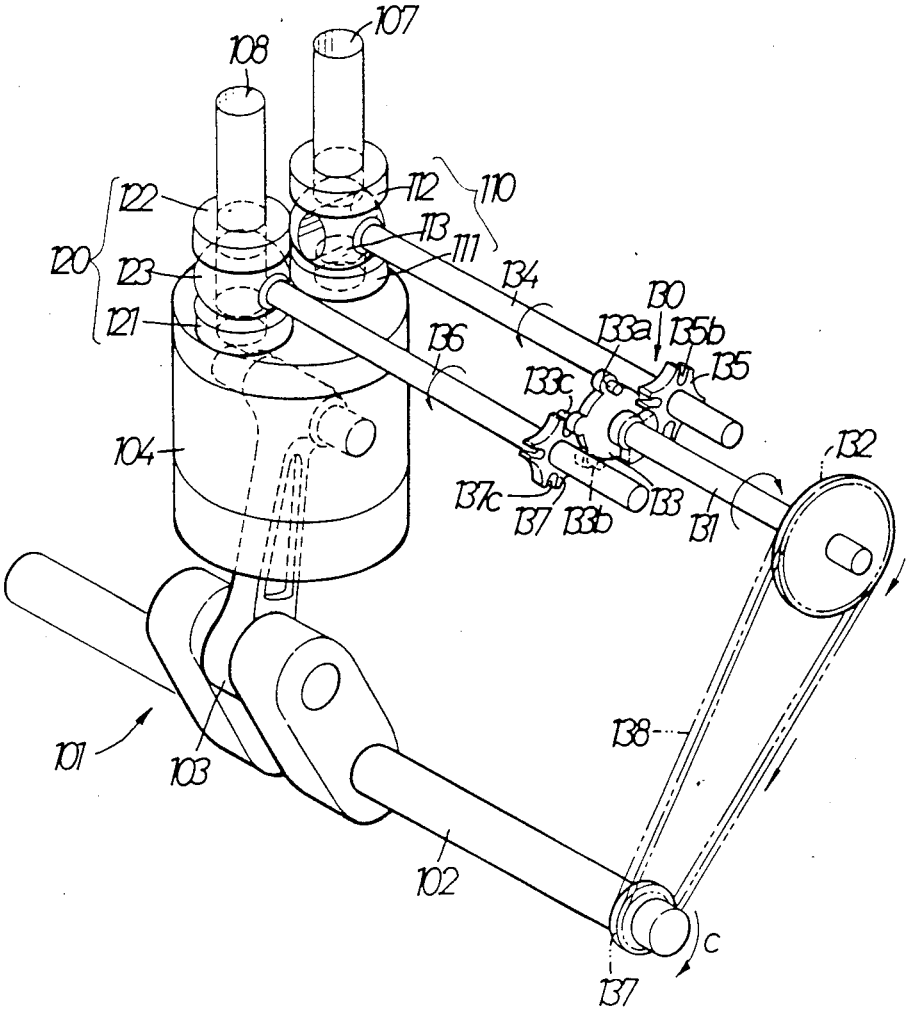
FIGS. 10 to 15 illustrating a second embodiment of the present invention, FIG. 10 being a schematic perspective view of an internal combustion engine to which a valve operating mechanism of the second embodiment is applied.
Figure 12:
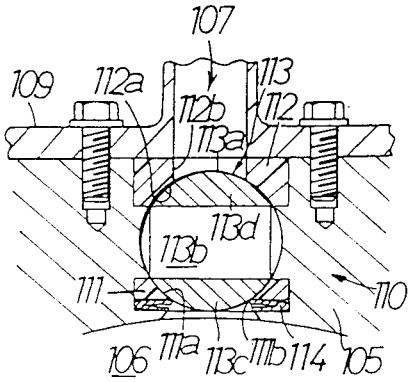

When the crank shaft 102 is rotated in the clockwise direction as shown in FIG. 10, the main shaft 131, with this rotation, is rotated in the clockwise direction c. Now, when the driving wheel 133 and the driven wheels 135 and 137 are in the positioned relation to one another as shown in FIG. 11, the pin 133*b* in the driving wheel 133 for closing the intake rotary valve 110, before the pin 133*a* for opening the intake rotary valve 110 will engage the groove 135*a* of the driven wheel 135, is in the state in which it has been slipped out of the groove 135*d*. In this state, the rotary valve 110 is at a stop (pause) in the completely closed state, with the valve body 113 blocking the intake passage 107 as shown in FIG. 12. At this time, one side wall 113*c* of the valve body 113 faces the combustion chamber 106.

Figure 14:
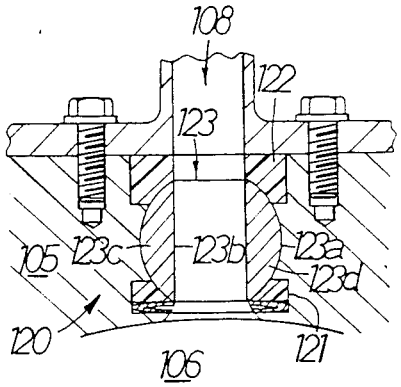

On the other hand, when the pin 133*c* in the driving wheel 133 for opening the exhaust rotary valve 120 is being slipped out of the groove 137*a* of the driven wheel 137 and the pin 133*d* for closing the rotary valve 120 is unengaged in the groove 137*b*, the rotary valve 120 is at a stop (pause) in the completely opened state, with the valve body 123 thereof opening the exhaust passage 108 as shown in FIG. 14.

Figure 13:
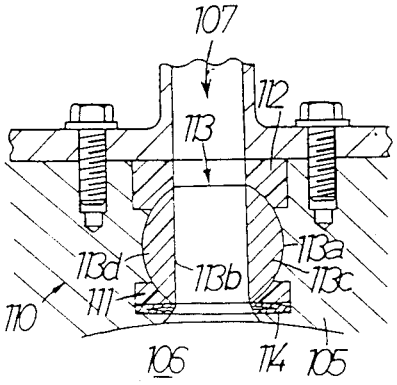
Figure 15:
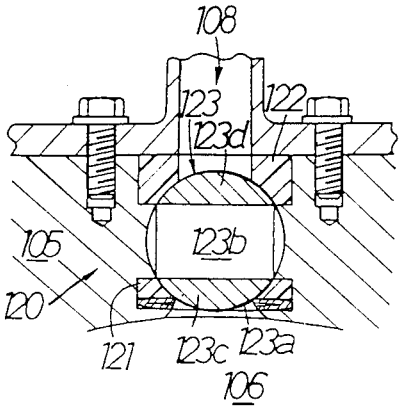

When the driving wheel 133 is subsequently rotated, the valve body 113 is rotated through 90° in the counterclockwise direction up to the upright state of the bore 113*b* after the opening pin 133*a* has engaged the groove 135*a* of the driven wheel 135 and until the pin 133*a* has been slipped out of such groove 135*a* and thus, the rotary valve 110 is completely opened as shown in FIG. 13. On the other hand, after the closing pin 133*d* has engaged the groove 137*b* of the driven wheel 137 and until it has been slipped out of such groove 137*b*, the valve body 123 is rotated through 90° in the counterclockwise direction to completely block the exhaust passage 108, with the bore 123*b* therein assuming the horizontal position as shown in FIG. 15 and thus, the rotary valve 120 is completely closed. At this time, one side wall 123*c* of the valve body 123 faces the combustion chamber 106. The rotary valve 110 is at a stop in the above-mentioned completely opened state until the closing pin 133*b* in the driving wheel 133 has engaged the groove 135*b* of the driven wheel 135.

After the closing pin 133*b* in the driving wheel 133 has engaged the groove 135*b* of the driven wheel 135 and until it has been slipped out of such groove, the valve body 113 is rotated through 90° in the counterclockwise direction and thus, the rotary valve 110 is completely closed again as shown in FIG. 12. Between the start of opening the rotary valve 110 and the end of closing it, the intake operation is conducted. The rotary valve 110 is stopped in the completely opened state for a certain period of time within this duration of intake operation as described above and therefore, an effective mixed-gas suction stroke is provide.

Until the opening pin 133*c* in the driving wheel 133 engages the groove 137*c* of the driven wheel 137, the two rotary valves 110 and 120 are at a stop in the completely closed states and for this duration, the individual strokes of compression and explosion are provided. The valve body 123 is rotated through 90° in the counterclockwise direction for a period from the engagement of the opening pin 133*c* in the driving wheel 133 with the groove 137*c* of the driven wheel 137 up to the slipping of the pin 133*c* out of such groove, so that the rotary valve 120 is brought again into the completely opened state as shown in FIG. 14 and remains in this completely opened state until the closing pin 133*d* engages the groove 137*d*. For a duration from the start of opening the rotary valve 120 to the end of closing it, exhausting is conducted. The rotary valve 120 is at a stop in the completely opened state for a certain period of time within this exhausting duration as described above and consequently, an effective exhausting is provided.

The above-described operation is repeatedly conducted, and the valve bodies 113 and 123 of the rotary valves 110 and 120 are intermittently rotated in one direction, i.e., in the counterclockwise direction to control the opening and closing of the intake and exhaust passages 107 and 108. In the explosion stroke of the engine 101, the respective side walls 113*c*, 113*d*, 123*c* and 123*d* of the rotary valves 110 and 120 alternately face the combustion chamber 6. As a result, in the second embodiment, the distribution in temperature of the valve bodies 113 and 123 is uniform over the whole, so that the deformation thereof due to the heat may be uniform to provide an improvement in sealing property and also to inhibit a seizure phenomenon due to a locally increased temperature.

As discussed above, in the second embodiment, the continuous rotation of the crank shaft 102 is transmitted in the form of an intermittent rotational movement to the rotary valves 110 and 120 through the Geneva stop mechanism as a valve operating mechanism according to the present invention to provide an extremely effective control of the opening and closing of the intake and exhaust passages 107 and 108 in accordance with the operation of the engine.

Figure 16:
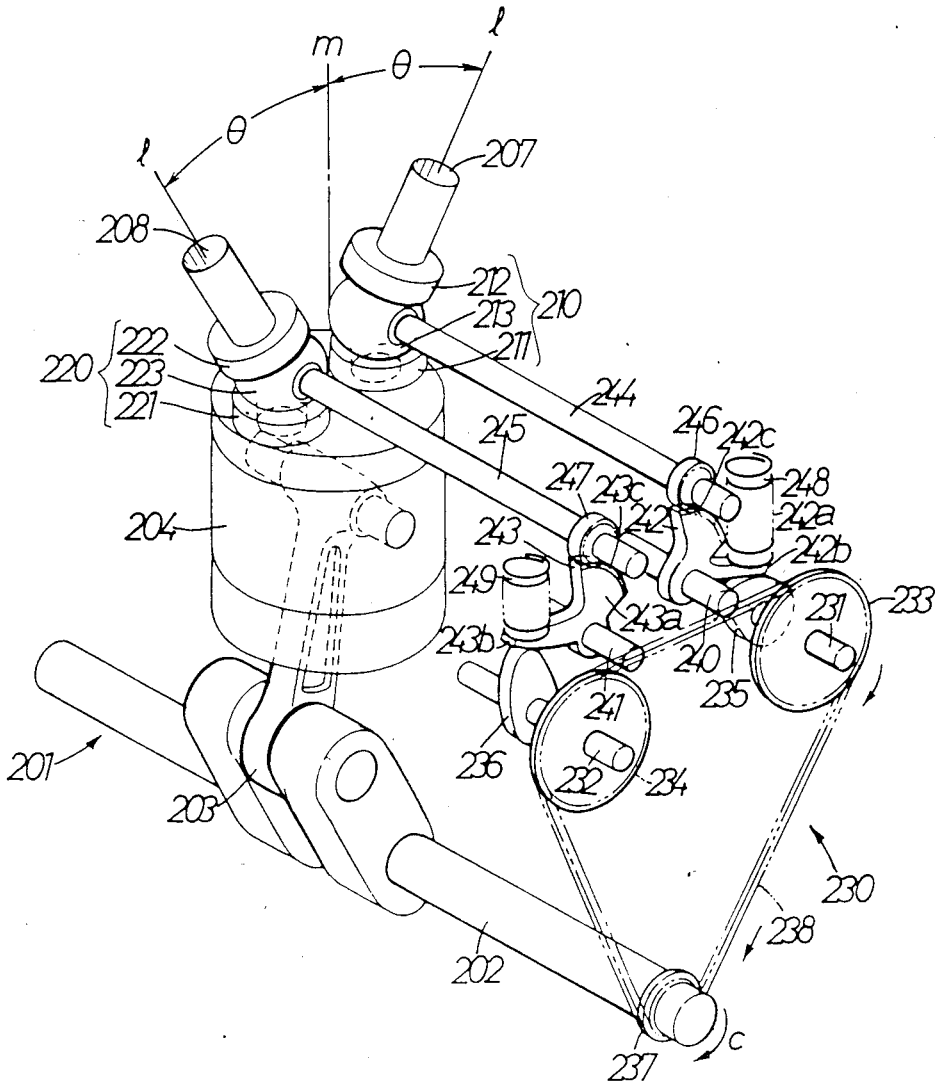
FIGS. 16 to 18 illustrate a third embodiment of the present invention, FIG. 16 being a schematic perspective view of an internal combustion engine to which the third embodiment is applied.
Figure 17:
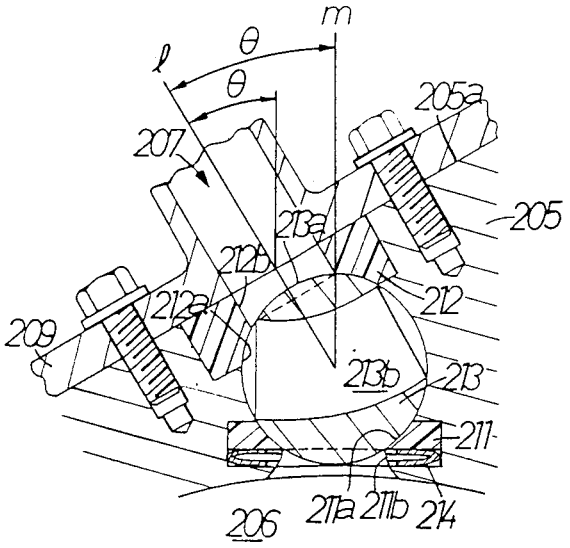
Figure 18:
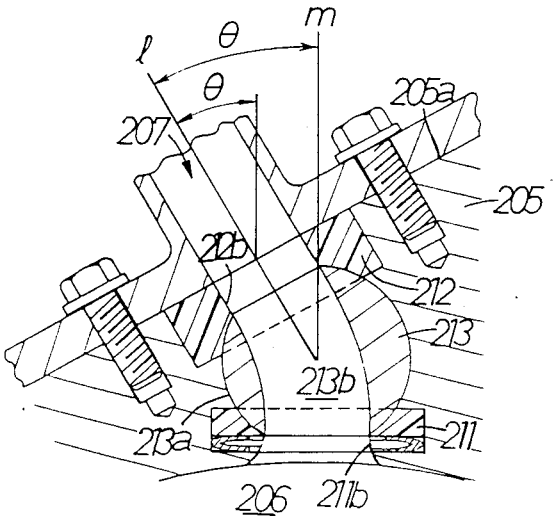

The following is the description of a third embodiment of the present invention with reference to FIGS. 16 to 18.

In this embodiment, the construction of rotary valves 210 and 220 and the mounting of intake and exhaust passages 207 and 208 to a cylinder head 205 are different from those in the first embodiment, and the other arrangements, including a valve operating mechanism, are similar to those in the first embodiment.

The rotary valves 210 and 220 are each a spherical valve. The intake rotary valve 210 is constituted of valve seat members 211 and 212, valve body 213, and a seal spring 214 as shown in FIGS. 16 and 17. The valve seat members 211 and 212 of the rotary valve 210 are disk-shaped and have spherical valve seat surfaces 211*a* and 212*a* concavely provided at a predetermined radii of curvature on one opposed end surfaces thereof and bores 211*b* and 212*b* perforated in the central portions thereof and having the same diameter as the inner diameter of the intake passage 207. Each of the valve seat members 211*b* and 212*b* is formed of a material having excellent heat and wear resistances such as a ceramic material, as in the first embodiment. The valve body 213 is spherical, with the radius thereof being set at the same value as the radius of curvature of the valve seat surfaces 211*a* and 212*a*, and the outer peripheral surface 213*a* of the valve body 213 is formed so that it may come into close contact with each of the valve seat surfaces 211*a* and 212*a*. The valve body 213 has a bore 213*b* made therein and having a diameter equal to that of the intake passage 207. The bore 213*b* extends through the central portion of the valve body 213 and is curved with a predetermined radius of curvature, with each of the opposite ends thereof being circularly arcuate and opened at a selected point of the outer peripheral surface 213*a*.

The cylinder head 205 is roof-shaped with a pair of slant surfaces 205*a* (only one shown in FIGS. 17 and 18) on the upper portion thereof. In such a state that a head cover 209 provided with the intake and exhaust passage 207 and 208 has been mounted on the slant surface 205*a*, the axis 1 of each of the intake and exhaust passage 207 and 208 forms a suitable angle (port angle) $\theta$ with respect to a vertical line m corresponding to the cylinder axis in this embodiment.

As shown in FIG. 17, within the cylinder head 205, the valve seat member 212, the valve body 213, the valve seat member 211 and the seal spring 214 are disposed in the intake rotary valve 210 in the order from the opened end of the intake passage 207 and fixed by the head cover 209 threadedly secured to the cylinder head 205. In this installed state, the outer peripheral surface 213*a* of the valve body 213 is rotatably biased into slide contact with the each of the valve seat surfaces 211*a* and 212*a* of the valve seat members 211 and 212 by the spring force of the seal spring 214. When the bore 213*b* in the valve body 213 is substantially perpendicular to the intake passage 207, this passage 207 is completely closed (see FIG. 17), and when the bore 213*b* is aligned with the intake passage 207, this passage is completely opened (see FIG. 18).

The exhaust rotary valve 220 is constituted in the very same manner as the intake rotary valve 210 and disposed within the cylinder head 205 at the opened end, of the exhaust passage 208, close to the combustion chamber 206.

The operation of this embodiment is entirely similar to that of the first embodiment and therefore, the description thereof is omitted.

Since the intake and exhaust passages 207 and 208 are at a port angle of $\theta$, i.e., they are disposed in inclination at a certain angle with respect to the cylinder axis in this embodiment, they can be freely oriented with respect to the center of the valve body to improve the freedom in layouts of the individual rotary valves and the valve operating mechanism or the like and consequently, the level of the engine can be lowered, thus making it possible to provide a compact design.

Description will now be made of a fourth embodiment of the present invention with reference to FIGS. 19 to 24.

In this embodiment, a valve operating system is shown as being applied to a four valve type engine.

Referring to FIGS. 19 to 24, there is shown a four valve type engine indicated by the reference numeral 301, and a piston 305 is connected to a crank shaft 302 of the engine 301 through a connecting rod 302*a*. A combustion chamber 306 having a reverse V-shaped section is defined between the upper end surface of the piston 305 and a recess 304 of a cylinder head 304 (see FIG. 22). Two intake rotary valves 310 and 310' and two exhaust rotary valves 320 and 320' are disposed in the vicinity of the opened ends, close to the combustion chamber 306, of the intake passage 307 and the exhaust passage 308 opened into the upper portion of the combustion chamber 306, respectively. Each of these rotary valves 310, 310', 320 and 320' is connected to a Geneva stop mechanism 330 as a valve operating mechanism driven by a crank shaft 302.

Figure 19:
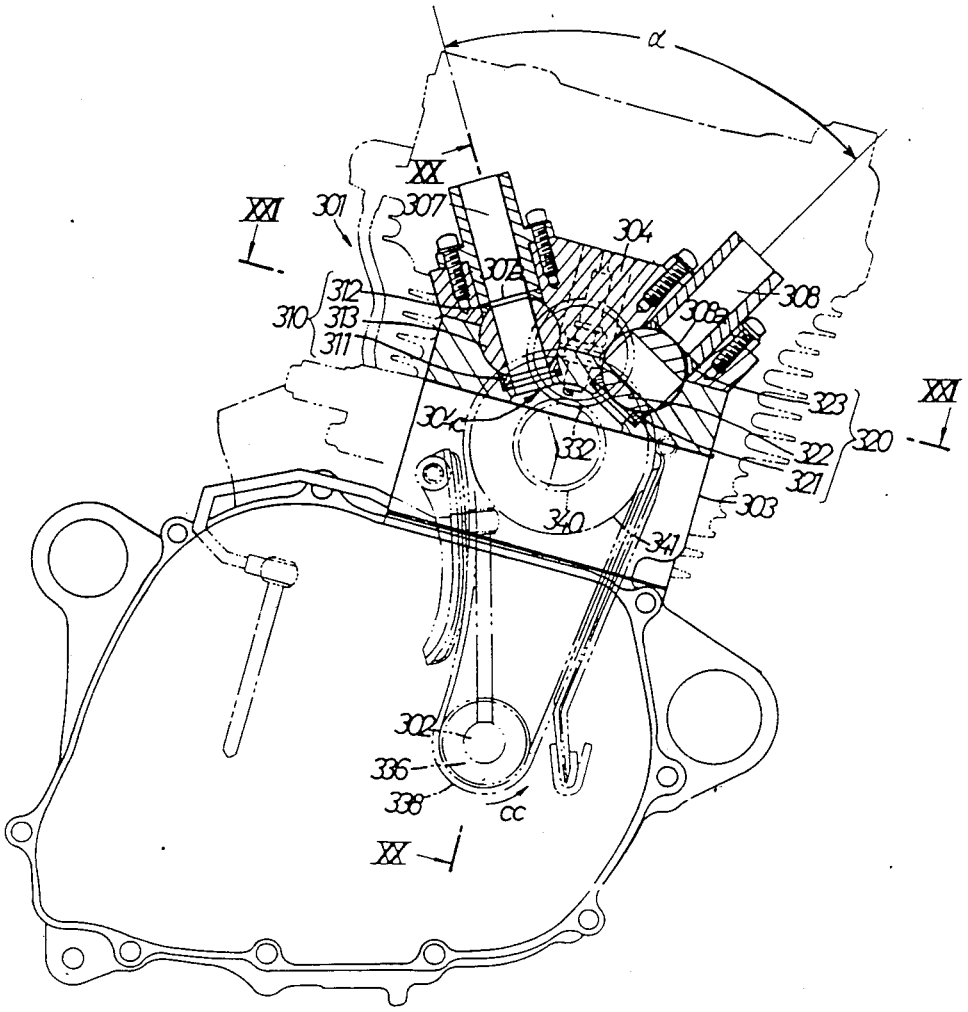
FIGS. 19 and 24 illustrate a fourth embodiment of the present invention, FIG. 19 being a sectional view of the details of an internal engine to which the fourth embodiment is applied.
Figure 20:
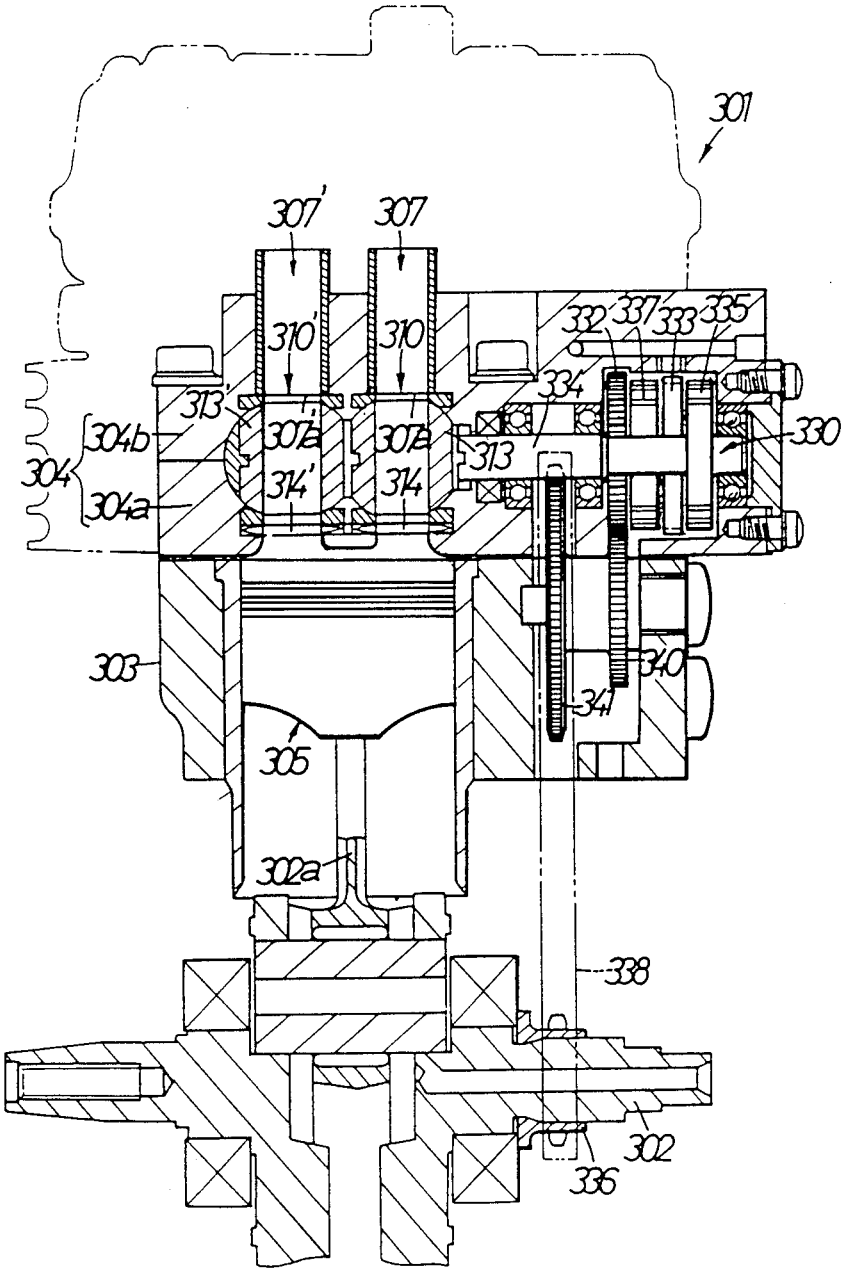
FIG. 20 being a sectional view taken along the line XX—XX of FIG. 19.
Figure 21:
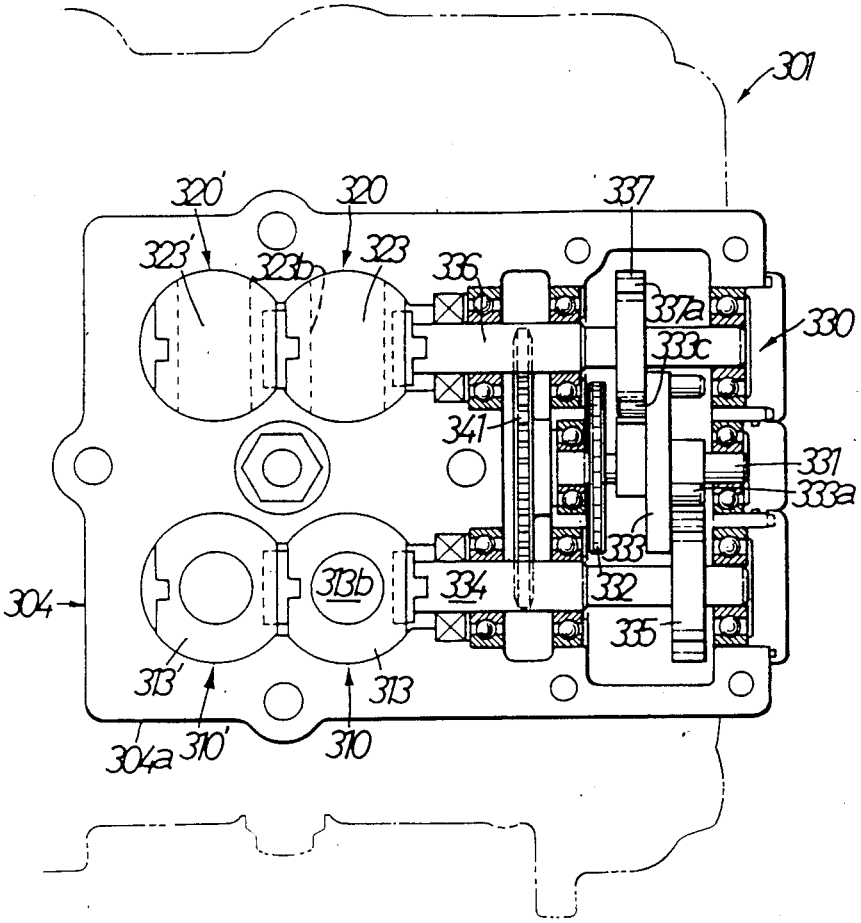
FIG. 21 being an end view taken along the line XXI—XXI of FIG. 19.
Figure 22:
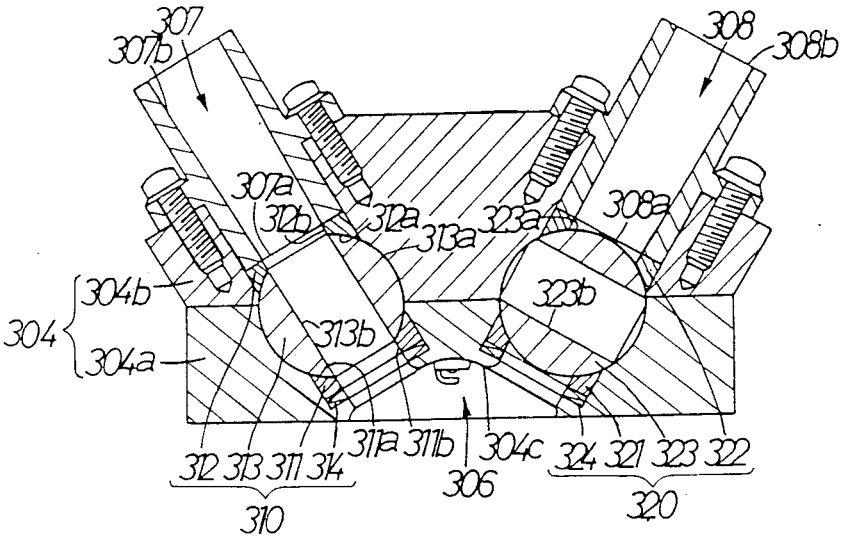
FIG. 22 being an enlarged sectional view of the details of FIG. 19.

The cylinder head 304 shown in FIG. 20 consists of two head portions 304*a* and 304*b* within which the intake passage 307 and the exhaust passage 308 are formed in a straight line as shown in FIGS. 19 and 22, with the center lines of the straight linear portions are symmetrically inclined outwardly at an equal angle from the cylinder axis and spreaded to form a predetermined angle $\alpha$.

The two intake rotary valves 310 and 310' and the two exhaust rotary valves 320 and 320' are interposed and held between both of the head portions 304*a* and 304*b*, so that the centers of the respective spherical valve bodies thereof may lie on the interface of the head portions 304*a* and 304*b*.

A main shaft 331 (see FIG. 21) constituting a portion of the Geneva stop mechanism 330 as a valve operating mechanism is rotatably journaled on the cylinder head 304 and has a driven sprocket 332 secured to one end thereof and a driving wheel 333 secured to the other end thereof. The driven sprocket 332 is meshed with an intermediate sprocket 340 and mounted integrally and coaxially with the intermediate sprocket 340. A transmitting belt, for example, a chain 338 is passed around another intermediate sprocket 341 (see FIG. 20) rotatably carried on a cylinder block 303 and around a driving sprocket 336 secured to one end of the crank shaft 302. The gear ratio of the intermediate sprocket 341 and the driving sprocket 336 is set at a value of 2:1 , while the gear ratio of the intermediate sprocket 340 and the driving sprocket 332 is set at a value of 1:1, so that the main shaft 331 is rotated in one rotation for every two rotations of the crank shaft 302. The rotary shafts 334 and 336 are rotatably journaled on the cylinder heads 304 and each have a driven wheel 335, 337 secured to one end thereof. At the other end of the rotary shaft 334, 336, the valve bodies 313 and 313', 323 and 323' of the rotary valves 310 and 310', 320 and 320' are interconnected by an Oldham's coupling for rotation together with each other. The rotary shafts 334 and 336 are connected to the valve bodies 313 and 323 of the rotary valves 310 and 320 perpendicularly to the bores 313*b* and 323*b*, respectively.

The driving wheel 333 and the driven wheels 335 and 337 of the Geneva stop mechanism 330 are of the completely same construction as in the second embodiment of the present invention and therefore, the description thereof is omitted.

The following is the description of the fourth embodiment.

When the crank shaft 302 is rotated in the counterclockwise direction c, this rotation is transmitted through the driving sprocket 336, the chain 338, the intermediate sprockets 341 and 340 and the driven sprocket 332 to the main shaft 331, thereby causing the main shaft 331 to be rotated in the clockwise direction.

This clockwise continuous rotation of the main shaft 331 is transmitted in the form of an intermittent rotational movement from the individual rotary shafts 334 and 336 through the Geneva stop mechanism 330 as a valve operating system to the pair of intake rotary valves 310 and 310' and the pair of exhaust rotary valves 320 and 320'. Therefore, the intake rotary valves 310 and 310' and the exhaust rotary valves 320 and 320' are turned in unison with a lag of time by the Oldham's connection to provide the opening and closing control for the intake passages 307 and 307' and the exhaust passages 308 and 308', respectively.

Figure 23:
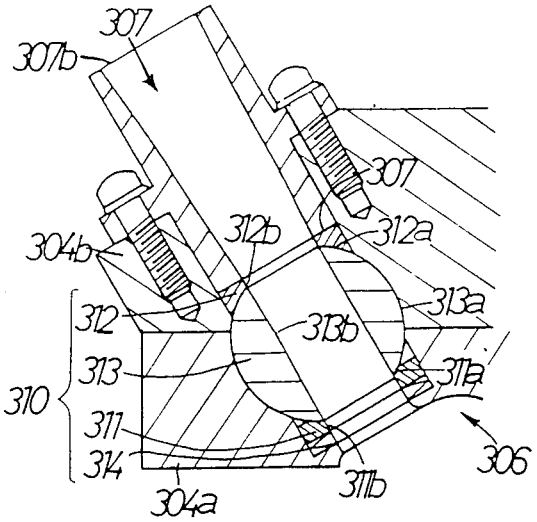
Figure 24:
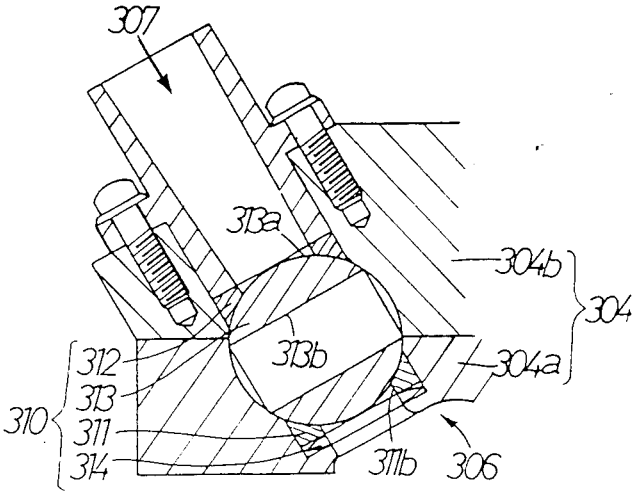

FIG. 23 shows one of the intake rotary valves 310 assuming the fully opened position and the intake passage 307 in communication with the combustion chamber 306, and FIG. 24 shows the intake rotary valve 310 assuming the fully closed position.

In this embodiment, because the intake passages 307 and 307' and the exhaust passages 308 and 308' are formed in a straight line and inclined so as to be spreaded outwardly away from each other at a predetermined angle, it is possible to provide a wider space between the intake rotary valves 310 and 310' and the exhaust rotary valves 320 and 320' disposed in the vicinity of the opened ends 307*a*, 307'*a*, 308*a* and 308'*a* of the passages 307, 307', 308 and 308', attendant with an ability to provide a large-sized construction for the individual rotary valves 310, 310', 320 and 320' and with an ability to increase the freedom in layouts of the rotary valves 310, 310', 320 and 320' and the Geneva stop mechanism 330 and to provide an improvement in assembling performance.

Further, the whole of the rotary valve can be large-sized, so that the effective port diameter may be correspondingly increased to provide an improvement in intake and exhaust efficiencies.

What is claimed is:

1. A valve operating system for an internal combustion engine, comprising an intake rotary valve and an exhaust rotary valve separately disposed in an intake passage and an exhaust passage, respectively, which independently communicate with a combustion chamber defined between a piston and a cylinder head in an internal combustion engine, said valves including spherical valve bodies adapted to open and close said intake and exhaust passages, respectively, and a valve operating mechanism having an intermittent operating function of rotatively driving said valve bodies of said intake and exhaust rotary valves in response to movement of said piston to provide an opening and closing control for said intake and exhaust rotary valves, and holding said rotary valve bodies in valve-opening and closing positions for respective predetermined periods of time, wherein said valve operating mechanism includes cam means adapted to be continuously rotated in one direction in response to the movement of said piston, rocker arms abutting said cam means and adapted to swing within a predetermined angle in accordance with the rotation of said cams, and rotary shafts each having one of said spherical valve bodies secured to one of the opposite ends thereof and adapted to reciprocally rotate between the valve-opening and closing positions of the valve body around an axis of said rotary shaft in accordance with the swinging movement of said rocker arm upon receiving a driving force from said rocker arm on the other end thereof, and said spherical valve bodies being each supported within said cylinder head through a valve seat member, and a seal spring being interposed between said valve seat member and the cylinder head.

2. A valve operating system for an internal combustion engine according to claim 1, including a further valve seat member for supporting said valve body on a side opposite to said valve seat member, said further valve seat member being supported on a head cover overlaid on and connected to an upper surface of the cylinder head.

3. A valve operating system for an internal combustion engine according to either one of claim 1 or claim 2, wherein said intake and exhaust passages have respective axes which extend in parallel to each other.

4. A valve operating system for an internal combustion engine according to either one of claim 1 or claim 2, wherein said intake and exhaust passages have respective axes which are inclined with respect to an axis of a cylinder containing said piston slidably received therein in a manner that said axes are more spacd away from each other as they are far off said combustion chamber.

5. A valve operating system for an internal combustion engine according to either one claim 1 or claim 2, wherein said valve body has a straight bore therein.

6. A valve operating system for an internal combustion engine according to either one of claim 1 or claim 2, wherein said valve body has a bore of a curved configuration.

7. A valve operating system for an internal combustion engine according to claim 1, wherein each or said rocker arms is formed with a gear, and each of said rotary shaft is securely provided at its other end with a gear meshed with said gear of the rocker arm.

8. A valve operating system for an internal combustion engine, comprising intake and exhaust rotary valves, respectively disposed in intake and exhaust passages communicating with a combustion chamber in an internal combustion engine said valves including spherical valve bodies adapted to open and close said intake and exhaust passages, respectively, and a valve operating mechanism including intake and exhaust cam shafts rotated by a crank shaft cams respectively integral with said cam shafts, first rotary shafts which are rotatable, arms secured to said first rotary shafts for swinging movement about the corresponding first rotary shafts through the rotation of said cams and second rotary shafts, which are rotatable and have one of opposite ends secured with gears meshed with gears respectively formed on said cams and have at the other ends secured with spherical valve bodies of said intake and exhaust rotary valves; whereby said valve operating mechanism has an intermittent operating function of rotatively driving the valve bodies of said intake and exhaust rotary valves interlockingly with the movement of a piston in the internal combustion engine to provide the opening and closing control for said intake and exhaust rotary valves, and holding said rotary valves in their opened and closed positions for a predetermined period of time.

9. A valve operating system for an internal combustion engine according to claim 8, wherein said valve operating mechanism (30; 230) reciprocably rotate said intake and exhaust rotary valves (10, 20; 210, 220) within a region of a predetermined angle interlockingly with the movement of the piston (4; 204) in the internal combustion engine (1; 201).

* * * * *